United States Patent [19]

Perelli et al.

[11] 4,383,251

[45] May 10, 1983

[54] TIMED SMOKE DETECTION

[76] Inventors: David E. Perelli; Stephen J. Perelli, both of 88 Green Ave., Madison, N.J. 07940; John B. Jenkins, II, Villa Apt., Bldg. 4, Apt. 12, Frenchtown, N.J. 08825

[21] Appl. No.: 307,488

[22] Filed: Oct. 1, 1981

[51] Int. Cl.[3] ..... G08B 23/00; G08B 17/10

[52] U.S. Cl. ..... 340/527; 340/309.6; 340/628

[58] Field of Search ..... 340/628, 81 R, 527, 340/528, 309.6

[56] References Cited

U.S. PATENT DOCUMENTS 4,105,996 8/1978 Shimizu ..... 340/81 R X 4,313,110 1/1982 Subulak et al. ..... 340/628

*Primary Examiner*—John W. Caldwell, Sr.

*Assistant Examiner*—Daniel Myer

*Attorney, Agent, or Firm*—Thomas L. Adams

[57] ABSTRACT

A smoke detector includes a sensing unit which has a power terminal adapted to receive electrical energy. A timing device in the smoke detector includes a switch, a timer and a manually operable device. The switch is coupled to the power terminal for interrupting current thereat. The timer can operate the switch to cause interruption of current at the power terminal for a predetermined interval. The manually operable device can actuate the timing means and start its predetermined interval.

13 Claims, 2 Drawing Figures

FIG. 1
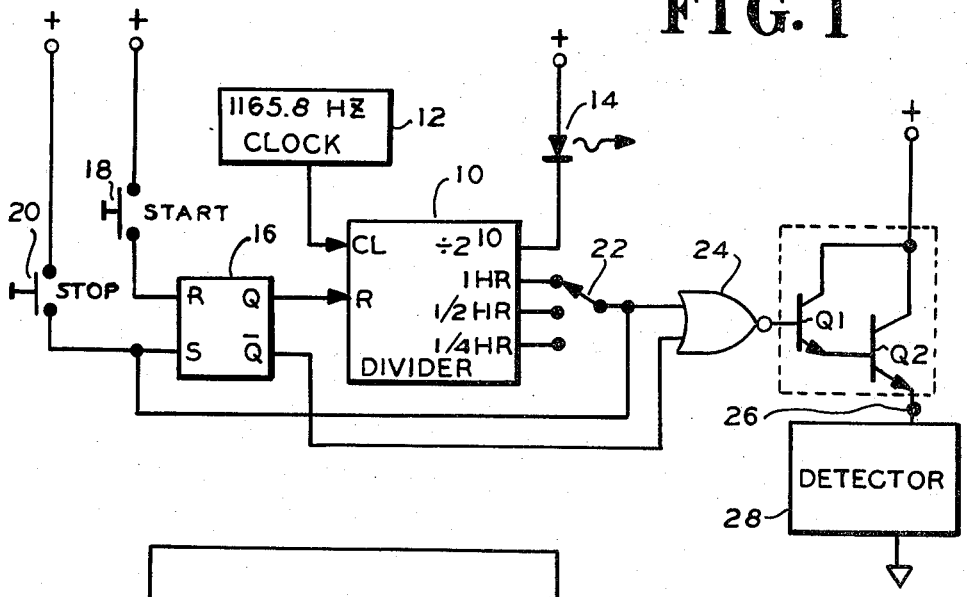
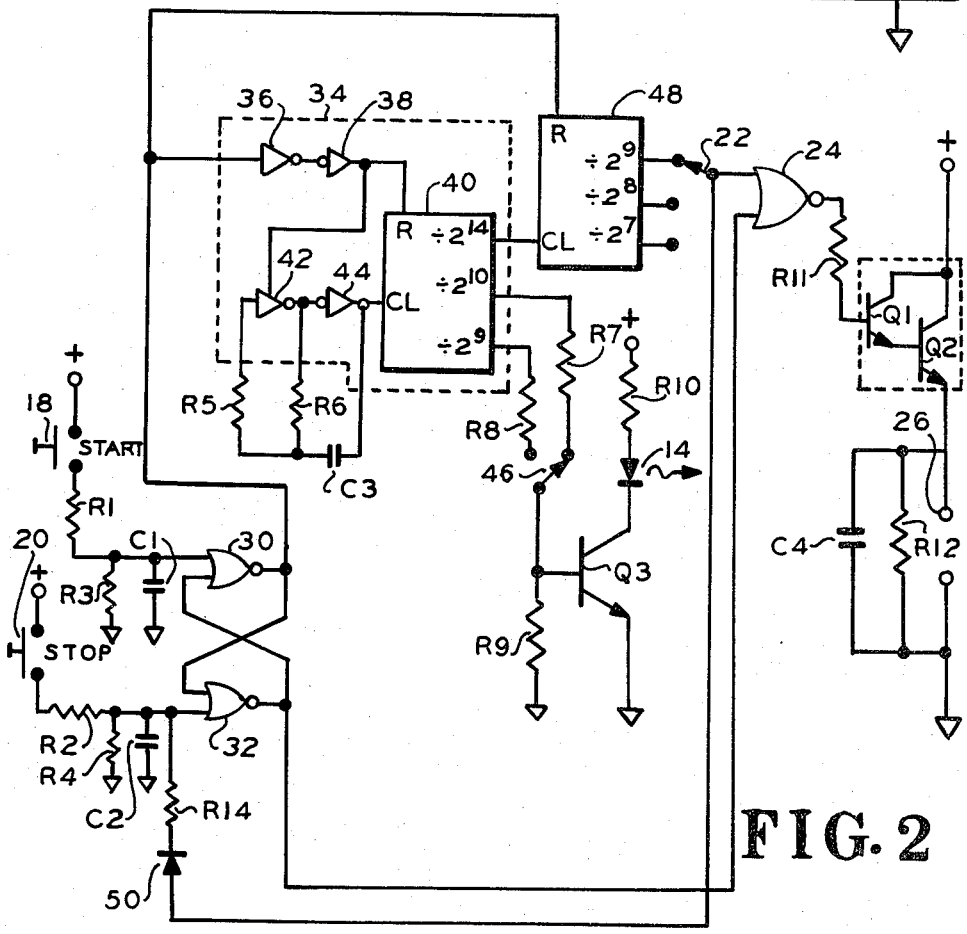
FIG. 2

TIMED SMOKE DETECTION

BACKGROUND OF THE INVENTION

The present invention relates to timers and, in particular, to timers used to interrupt the power to a smoke detector for a predetermined interval.

It is known to use a timer in connection with an alarm system that can detect smoke. This known timer determines whether the sensed condition persists for a minimum duration before sounding an alarm. A disadvantage with this system is that it does employ a manual override and therefore cannot adequately handle smoky conditions that may persist for a relatively long time but which are not dangerous. For example, during its use smoke may persist in a kitchen and timed alarms according to the prior art will be triggered by this non-dangerous smoky condition. It is also known to use a smoke detector to actuate a fan for a predetermined interval of time. Of course, this known system will respond to all smoky conditions, even relatively brief ones.

Also known is a burglar alarm which has a manual disabling switch which, when actuated, prevents the burglar alarm from sounding for a predetermined interval, allowing an occupant to enter or leave a protected area without sounding the alarm. However, these known systems have not been connected to smoke detectors and therefore have not operated with appropriately sized delays or with appropriate circuitry for disabling a smoke detector.

Accordingly, there is a need for a manually operable timer for disabling a smoke detector for a predetermined interval when non-dangerous smoke may be present.

SUMMARY OF THE INVENTION

In accordance with the illustrative embodiment demonstrating features and advantages of the present invention, there is provided in a smoke detector having a sensing unit, a timing device. The sensing unit has a power terminal adapted to receive electrical energy. The timing device includes a switch means, a timing means and a manually operable means. The switch means is coupled to the power terminal for interrupting current thereat. The timing means can operate the switch means to cause interruption of current at the power terminal for a predetermined interval. The manually operable means can actuate the timing means and start its predetermined interval.

In a related method according to the principles of the same invention, a smoke detector is operated in an occasionally smoky environment with a clock and a switch. The method includes the step of manually actuating the switch to remove power from the smoke detector but not the clock when smoke is observed. The method also includes the step of operating the switch to restore power to the smoke detector after the expiration of a predetermined interval, whose duration is measured by the clock.

By using apparatus and methods according to the foregoing, a relatively effective and efficient technique is provided for preventing unnecessary alarms from a smoke detector. In a preferred embodiment, a start and stop button is used to control a timer. By actuating the start button, the timer is caused to remove power from the smoke detector for a preset interval, for example, fifteen to sixty minutes. The stop button can be used to terminate the timed interruption of power to the smoke detector and render it immediately operable. This latter feature is useful where the smoky condition clears sooner than normally expected.

In a preferred embodiment, a pulse generator is used as a clock to drive a divider which produces pulses having a selectable duration of fifteen, thirty or sixty minutes. Preferably, a bistable multivibrator is connected with the divider to keep it reset or to set it free to divide. A start and stop switch directly controls the multivibrator and can change its state. Also in a preferred embodiment, after the timer has changed state at the end of its predetermined interval, this change in state is fed back to the multivibrator to drive it to a state causing resetting of the divider.

Also in a preferred embodiment, the timer and the multivibrator operate through a gate to drive a pair of Darlington-connected transistors. This pair of transistors is used to switch current supplied from a battery to the smoke detector. Also in a preferred embodiment, an output of the divider which is cycling at the rate of approximately one Hertz is used to drive a flasher, for example, a light emitting diode. This flasher then indicates the existence of the interruption interval and alerts the occupant.

BRIEF DESCRIPTION OF THE DRAWINGS

The above brief description as well as other objects, features and advantages of the present invention will be more fully appreciated by reference to the following detailed description of a presently preferred but nonetheless illustrative embodiment in accordance with the present invention when taken in conjunction with the accompanying drawings wherein:

FIG. 1 is a schematic block diagram of a timing device according to the principles of the present invention; and FIG. 2 is a more detailed schematic diagram of the timing device of FIG. 1.

DETAILED DESCRIPTION OF THE PREFERRED EMBODIMENT

Referring to FIG. 1, a timing means is shown herein comprising a divider 10 having a clock input CL driven by a 1165.8 Hz clock 12. It will be appreciated that the frequency of this clock can be adjusted depending upon the amount of division provided by divider 10 as well as the timing desired from divider 10. In this embodiment, divider 10 has output terminals identified herein as one hour, ½ hour, ¼ hour which signifies division by $2^{23}$, $2^{22}$ and $2^{21}$, respectively. A terminal, which in this embodiment causes division by a factor of $2^{10}$, is connected to the cathode of light emitting diode 14, whose anode connects to a source of positive potential. Diode 14 is referred to herein as a light emitting source. Resetting input R of divider 10 is connected to output Q of a bistable means shown herein as bistable multivibrator 16 which is in this embodiment an RS flip-flop. Flip-flop 16 is connected to a manually operable means shown herein as start switch 18 and stop switch 20. Start switch 18 is serially connected between reset input R of flip-flop 16 and a source of positive potential. Stop switch 20 is serially connected between that source of positive potential and set input S of flip-flop 16. The plurality of output terminals (1 hour, ½ hour and ¼ hour) of divider 10 are selectable by means of switch 22 to input S of flip-flop 16 and one input of NOR gate 24, whose other input connects to output $\overline{Q}$ of flip-flop 16.

The output of NOR gate 24 connects to a switch means shown herein as Darlington-connected pair of transistors Q1 and Q2, whose collectors of both connect to a source of positive potential. The output of NOR gate 24 connects to the base of transistor Q1, whose emitter connects to the base of transistor Q2. The emitter of transistor Q2 connects to a power terminal 26 of a conventional smoke detector 28.

In FIG. 2, a more detailed schematic of the apparatus of FIG. 1, the smoke detector has been deleted. Previously mentioned start switch 18 is serially connected with resistor R1 between a source of positive potential and one input of NOR gate 30, whose other input connects to the output of NOR gate 32. Previously mentioned stop switch 20 is shown serially connected with resistor R2 between the source of positive potential and one input of NOR gate 32, whose other input connects to the output of NOR gate 30. Resistor R3 and capacitor C1 are connected in parallel between ground and the junction of resistor R1 and NOR gate 30. Resistor R4 and capacitor C2 are connected in parallel between ground and the junction of NOR gate 32 and resistor R2. Integrated circuit 34 is shown containing a divider 40 and four inverters. The output of NOR gate 30 is connected to the input of inverter 36, whose output is connected to the input of inverter 38, the output of the latter being connected to reset input R of divider 40 and a supplemental input of inverter 42. This supplemental input drives inverter 42 to a predetermined state regardless of any other input. Serially connected between the input and output of inverter 42 are resistors R5 and R6, whose junction is connected to one terminal of capacitor C3, its other terminal being connected to the output of the inverter 44 and clock input CL of divider 40. The output of inverter 42 connects to the input of inverter 44 to complete a positive feedback loop causing inverter 42 and 44 to oscillate, preferably, at 1165.8 Hz. Divider 40 has output terminals identified as $\div 2^{14}$, $\div 2^{10}$ and $\div 2^{9}$ indicating the division performed at each respective terminal. The latter two terminals are separately connected with resistors R7 and R8 which lead to the switched terminals of switch 46 so that one of those resistors can connect to the base of transistor Q3 and one terminal of resistor R9, whose other terminal is grounded. Transistor Q3 has its emitter connected to ground and its collector connected to the cathode of light emitting diode 14. Resistor R10 is connected between the source of positive potential and the anode of diode 14. Terminal $2^{14}$ of divider 40 connects to clock input CL of divider 48, whose reset input R connects to the output of NOR gate 30. Division by $2^{9}$, $2^{8}$ and $2^{7}$ are provided by terminals $\div 2^{9}$, $\div 2^{8}$ and $\div 2^{7}$, respectively, each being selectable by switch arm 22 which connects to the anode of diode 50 and one input of NOR gate 24. The other input of NOR gate 24 connects to the output of NOR gate 32. Resistor R14 connects between the cathode of diode 50 and the junction of capacitor C2 and NOR gate 32. Resistor R11 connects between the output of NOR gate 24 and the base of transistor Q1, whose emitter connects to the base of transister Q2. The collectors of transistors Q1 and Q2 both connect to the source of positive potential. The emitter of transistor Q2 connects to previously identified terminal 26. A degree of filtering is provided by the parallel combination of capacitor C4 and resistor R12 which connect between terminal 26 and ground.

To facilitate an understanding of the principles associated with the foregoing apparatus, its operation will be briefly described. It is initially assumed that detector 28 is operating in a smokeless environment and is not sounding an alarm. An occupant of a room protected by detector 28 may now notice the onset of a smoky condition caused by acitvity such as cooking. Accordingly, the detector 28 may be about to sound or may, in fact, have sounded unnecessarily. Therefore, an occupant of the protected room may preclude or terminate such an alarm by depressing start switch 18 which applies positive potential to one input of NOR gate 30 (FIG. 2) to produce a low output therefrom. This couples a low signal to reset inputs R of dividers 40 and 48 allowing them to commence counting. At this time, the outputs of divider 48 are low and, assuming switch 20 is open, both inputs to NOR gate 32 are low. Consequently, it applies a high signal to an input NOR gate 24, whose resulting low output turns transistors Q1 and Q2 off. Therefore, power is removed from terminal 26 and no alarm can sound from detector 28. NOR gate 32, receiving low inputs from switch 20, divider 48 and NOR gate 30, applies to the latter a high signal so that switch 18 can now be released without further effect.

Pulses are provided by the oscillator composed of inverters 42 and 44 connected in a positive feedback arrangement. They apply pulses to clock input CL of divider 40 at a 1165.8 Hz rate. Consequently, pulses are produced from terminal $\div 2^{10}$ at approximately a one Hertz rate which when coupled through resistor R7 cause transistor Q3 to become periodically conductive at the same rate. Therefore, light emitting diode 14 flashes and alerts the occupant of the protected room of the operation of timer 34 and the interruption of the smoke detector.

Pulses are provided by terminal $2^{14}$ of divider 40 at about a 0.07 Hz rate so that divider 48 can produce on terminals $\div 2^{9}$, $\div 2^{8}$ and $\div 2^{7}$ pulses which appear after the elapsing of 60, 30 and 15 minutes, respectively.

After approximately 60 minutes elapses, output terminal $\div 2^{9}$ of divider 48 produces a high signal. This high output is coupled through diode 50 to an input of NOR gate 32 causing it to produce a low output. The low output from NOR gate 32 is applied to one input of NOR gate 30, whose other input is now low since start switch 18, presumably, was not held closed for the full 60 minutes. Consequently, NOR gate 30 produces a high signal which is applied to one input of NOR gate 32 which completes the transfer of the state. Accordingly, current from diode 50 can end without further affect. The high output from NOR gate 30 is coupled to reset intputs R of dividers 40 and 48, causing their output terminals to become low, resulting in a low input being applied by switch 22 to one input of NOR gate 24. Since the other input of NOR gate 24 is connected to the low output of NOR gate 32, a high signal is applied to the base of transistor Q1 causing it and transistor Q2 to conduct. Consequently, power is delivered from the source of positive potential to power terminal 26. This completes a cycle wherein power was removed and has now been restored to the smoke detector 28 (FIG. 1).

It will be appreciated that the foregoing 60 minute interruption could be aborted by depressing stop switch 20. Such depression would apply a positive signal to NOR gate 32 in a fashion identical to that provided through blocking diode 50. In an identical fashion, counters 40 and 48 would be reset to produce a low signal on one input of NOR gate 24, whose other input receives from the the output of NOR gate 32 a low output in response to the closure of switch 20. Consequently, power would again be restored by rendering transistors Q1 and Q2 conductive.

It is to be appreciated that various modifications may be implemented with respect to the above described preferred embodiment. For example, the extent of division performed by the dividers can be altered depending upon the frequency on the clock driving them and the desired length of interruption. Furthermore, in some embodiments, instead of a clock and divider a mechanical clock can be employed to provide a similar result. It is also expected that the illustrated flip-flop may be deleted in embodiments so arranged that the divider enters the appropriate states in response to manually initiated signals. Furthermore, the illustrated Darlington-connected pair of transistors may be replaced by thyristors, relays or other appropriate switching devices. In addition, while a stop switch is convenient, it may not be employed in all embodiments. Similarly, the flashing, light emitting diode is optional. Moreover, the many illustrated components can be replaced with alternate components depending upon the desired power rating, speed, accuracy, temperature stability, size, etc.

Obviously, many modifications and variations of the present invention are possible in light of the above teachings. It is therefore to be understood that within the scope of the appended claims, the invention may be practiced otherwise than as specifically described.

What is claimed is:

1. In a smoke detector having a sensing unit, said unit having a power terminal adapted to receive electrical energy, a timing device comprising:

switch means coupled to said power terminal for interrupting current thereat, said switch means being operable to dissipate less power when interrupting current at said power terminal;

timing means for operating said switch means to cause interruption of current at said power terminal for a predetermined interval, said timing means and sensing unit having a common potential line, said switch means having a control terminal and a pair of switched terminals controlled thereby, the terminals of said switch means carrying potentials constrained within upper and lower limits, one of said limits being established by the potential on said common potential line; and manually operable means for actuating said timing means and starting its predetermined interval.

2. In a smoke detector according to claim 1 wherein said timing means is adjustable to alter the duration of said predetermined interval, said timing means having an input circuit for determining said predetermined interval, said input circuit having a time constant of less than one second.

3. In a smoke detector according to claim 1 wherein said timing means comprises:

a clock for providing regular pulses at a given rate; and a divider driven by said clock for providing a timing pulse to said switch means.

4. In a smoke detector according to claim 3 wherein said timing means includes:

a bistable means coupled to said timing means for rendering it monostable, said manually operable means being operable to drive said bistable means into a first one of a pair of states, said bistable means being operable in said first one of its states to render said timing means operative and to cause said switch means to interrupt current at said power terminal.

5. In a smoke detector according to claim 4 wherein said timing means is operable to drive said bistable means into a second one of said pair of states at the expiration of said predetermined interval in response to said divider reaching a predetermined count.

6. In a smoke detector according to claim 5 wherein said manually operable means is operable to drive said bistable means into said second one of said states, whereby current at said power terminal can be interrupted and restored by manual intervention.

7. In a smoke detector according to claim 6 wherein said bistable means is operable to reset said divider in said second one of said states.

8. In a smoke detector according to claim 7 wherein said divider has a plurality of output terminals, one of them being selectable to set the duration of said predetermined interval.

9. In a smoke detector according to claim 8 wherein said switch means comprises:

a Darlington-connected pair of transistors.

10. In a smoke detector according to claim 7 further comprising:

a light emitting source coupled to said divider and operable to be flashed at a rate proportional to the repetition rate of said clock, said bistable means being operable in response to said divider reaching a predetermined count to terminate counting and the flashing of said light emitting source.

11. In a smoke detector according to claim 10 wherein the duration of said predetermined interval is limited to a range substantially between fifteen to sixty minutes.

12. A smoke detector comprising:

a sensing means having a power terminal for providing an alarm signal in response to smoke;

a switch means coupled to said power terminal for interrupting current thereat, said switch means being operable to dissipate less power when interrupting current at said power terminal;

timing means for operating said switch means to cause interruption of current at said power terminal for a predetermined interval, said timing means and sensing unit having a common potential line, said switch means having a control terminal and a pair of switched terminals controlled thereby, the terminals of said switch means carrying potentials constrained within upper and lower limits, one of said limits being established by the potential on said common potential lines and manually operable means for actuating said timing means and starting its predetermined interval.

13. A method for operating a smoke detector in an occasionally smoky environment with a pulse generator and a switch, comprising the steps of:

manually actuating said switch to remove power from said smoke detector but not said pulse generator when smoke is observed;

counting pulses from said pulse generator;

operating said switch to restore power to said smoke detector after the expiration of a predetermined interval, whose duration is measured by the occurence of a predetermined number of pulses;

manually actuating said switch to restore power to said smoke detector if smoke is no longer observed before the expiration of said predetermined interval.

* * * * *